US006719229B2

(12) United States Patent
Aihara et al.

(10) Patent No.: US 6,719,229 B2
(45) Date of Patent: Apr. 13, 2004

(54) CRUSHER

(75) Inventors: Shuichi Aihara, Tokyo (JP); Yuichi Nagahara, Tokyo (JP)

(73) Assignee: Metso Minerals (Matamata) Limited, Matamata (NZ)

( * ) Notice: Subject to any disclaimer, the term of this patent is extended or adjusted under 35 U.S.C. 154(b) by 0 days.

(21) Appl. No.: 10/364,313

(22) Filed: Feb. 11, 2003

(65) Prior Publication Data

US 2003/0183711 A1 Oct. 2, 2003

Related U.S. Application Data

(63) Continuation of application No. PCT/JP01/06821, filed on Aug. 8, 2001.

(30) Foreign Application Priority Data

Aug. 11, 2000 (JP) ..... 2000-245047

(51) Int. Cl.[7] ..... B02C 19/00
(52) U.S. Cl. ..... 241/188.1; 241/275
(58) Field of Search ..... 241/5, 275, 188.1, 241/189.1

(56) References Cited

U.S. PATENT DOCUMENTS 5,058,815 A * 10/1991 Pozzato et al. ..... 241/275

FOREIGN PATENT DOCUMENTS

| | | |
|---|---|---|
| JP | 64-75049 | 3/1989 |
| JP | 6-79189 | 3/1994 |
| JP | 2000-153169 | 6/2000 |

* cited by examiner

*Primary Examiner*—Mark Rosenbaum
(74) *Attorney, Agent, or Firm*—Jacobson Holman PLLC

(57) ABSTRACT

The invention provides a crusher which can produce uniform finely pulverised material without having to increase the speed of the rotor, and which has a good rate of productivity. The crusher comprises crushing vanes 3 having extensions 35 formed protruding radially from the outer surface of the rotor 1 and extending below a raw material drop point A of a dead-bed 4, and an annular wall 5 similarly positioned below the raw material drop point A of the dead-bed 4, on an inner rim of a lower plate 22 of the crushing chamber 2, and pulverizing is effected by the material 7 which rebounds and falls from the dead-bed 4, striking the extensions 35 of the crushing vanes 3.

2 Claims, 7 Drawing Sheets

CRUSHER

This is a continuation of PCT/JP01/06821 filed Aug. 8, 2001 and published in Japanese.

FIELD OF THE INVENTION

The present invention relates to crushers that use centrifugal force to crush mineral or other such raw materials.

SUMMARY OF THE PRIOR ART

Crushers which employ the centrifugal force generated by a cylindrical rotor rotating at high speed to eject the raw material to be crushed so that it collides with a dead-bed formed around the rotor and is finely crushed are already known.

However, because they employ centrifugal force, crushers of the above-mentioned type have presented the following problems in relation to which improvements have been sought.

1. In order to break the raw material up more finely, one method that is considered is to increase the rotational speed of the rotor and hence the collision speed of the material. However, this requires a larger motor, which increases costs and also generates problems regarding increased weight of the machine.
2. When the rotor rotates at high speed (e.g. above 65 m/sec), the raw material collides at high speed with the surrounding surfaces, producing severe wear and tear of the crusher and leading to problems of durability.
3. To produce crushed material of uniform particle diameter, after crushing, the material is collected up and returned to the crusher to be treated again. However, the amount that must be returned, and the number of times it needs to be returned are so great that productivity is poor.

OBJECT OF THE INVENTION

It is therefore an object of the present invention to provide a crusher which can produce uniform finely pulverised material without having to increase the speed of the rotor, and which has a good rate of productivity.

It is a further object of the present invention to at least go some way to overcoming the disadvantages of the prior art, or at least to provide the public with a useful choice.

SUMMARY OF THE INVENTION

In a first aspect the present invention consists in a crusher comprising or including a cylindrical rotor which rotates about a vertical axis, and a pulverising chamber which houses said rotor, which performs a pulverising process by ejecting raw material to be crushed from ejection ports of rotor so that it collides with a surrounding dead-bed, wherein crushing vanes are provided on an outer face of the rotor protruding radially therefrom, and said crushing vanes are formed with an extension located slightly below a raw material drop point of said dead-bed.

Preferably, the crusher according to the present invention is provided with an annular wall inside said pulverising chamber, and located below the raw material drop point of said dead-bed.

In a second aspect the present invention consists in a crusher as described herein with reference to the accompanying figures.

DETAILED DESCRIPTION OF THE PRESENT INVENTION

Figure 1:
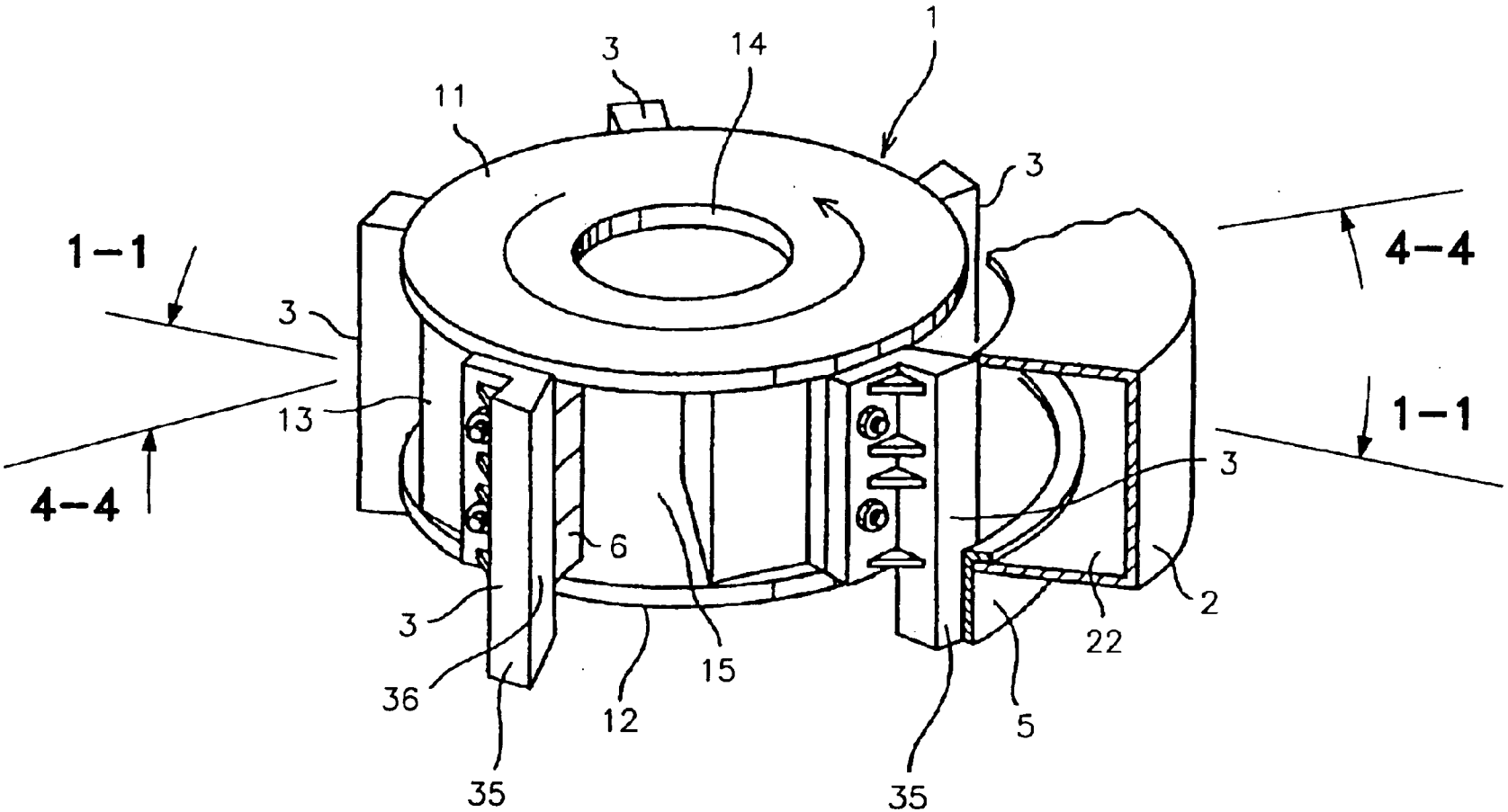
FIG. 1 is a partial cross-section view of part of a crusher according to a first embodiment of the present invention.

Embodiments according to the present invention are explained below, with reference to FIGS. 1 through 7.

First Embodiment of the Invention

1. Structure of the Crusher

A substantially drum-shaped rotor 1 is accommodated at the centre of the crusher, and a pulverising chamber 2 is formed surrounding the rotor 1.

Within the pulverising chamber 2, the raw material to be pulverized that is ejected from the rotor 1 accumulates to form a dead-bed 4 that curves upwards from a lower plate 22.

The lowest point of the curved dead-bed forms a raw material drop point A from which pulverized material falls.

2. The Rotor

The rotor 1 is formed in a drum shape, by axially aligned parallel opposing circular upper and lower plates 11 and 12 respectively, and a side-plate 13 which joins these at the circumference. The rotor rotates about its vertical axis.

A feeder port 14 is opened into the centre of the upper plate 11, so that the material to be crushed 7 can be fed continuously into the interior of the rotor 1.

At suitable intervals around the circumference, ejection ports 15 are formed in the side plate 13, so that the material 7 can be ejected towards the pulverising chamber 2.

In the vicinity of each ejection port 15, a tip 6 with the edge thereof made from a hard material is installed so as to prevent the material 7 from damaging the ejection port 15.

3. Crushing Vanes

A plurality of crushing vanes 3 are fitted to the outer surface of the rotor so as to protrude radially therefrom.

Figure 2:
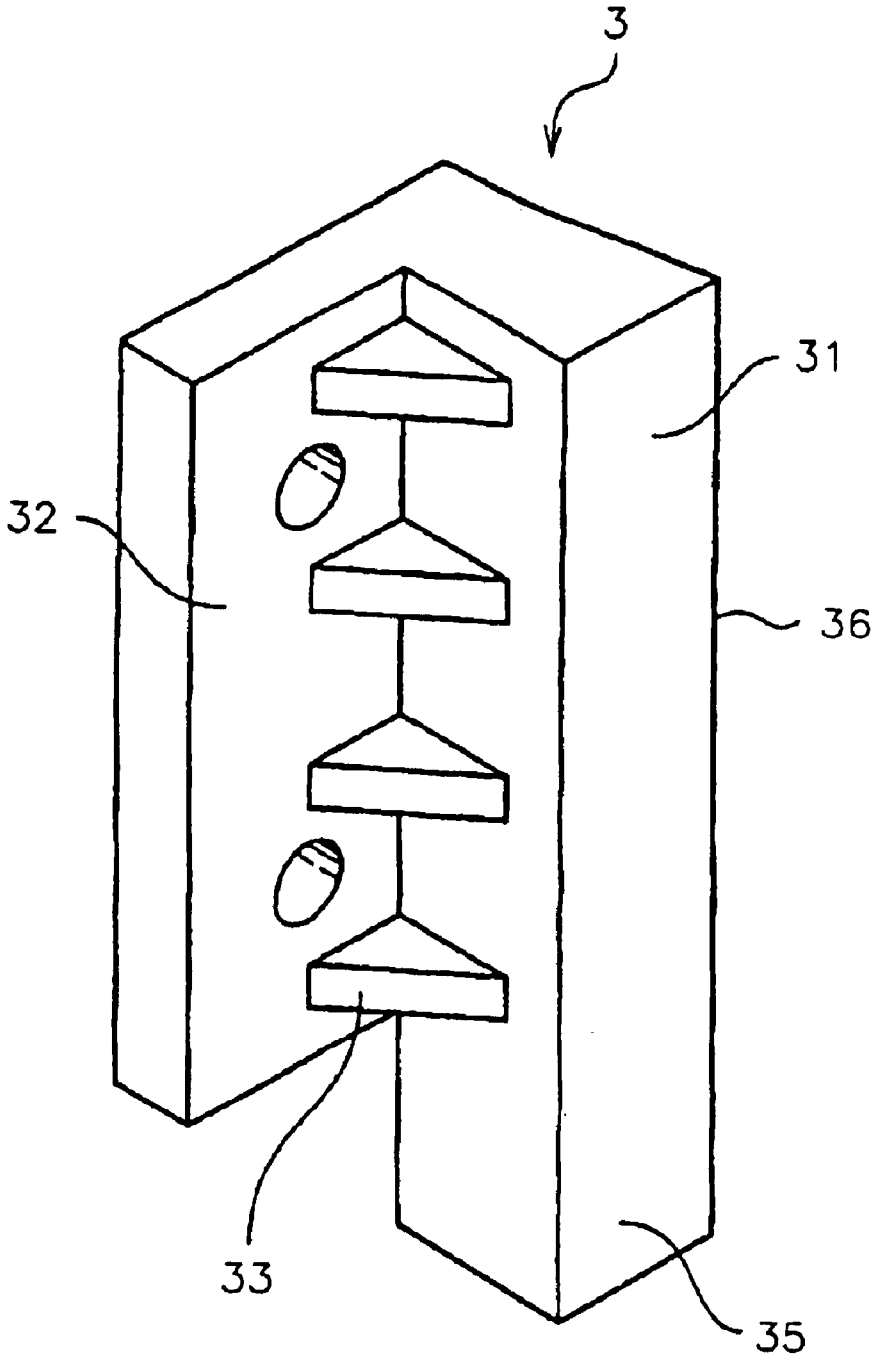
FIG. 2 is a perspective view of a crushing vane.

The crushing vanes 3 each comprise a crushing member 31 and an attachment member 32 which together form an L-shaped integral element, with the internal angle of the L braced by ribs 33 (see FIG. 2).

The crushing member 31 has a length at least equal to that of the side plate 13 of the rotor 1, and is furnished with a portion formed downward from the lower plate 12 serving as an extension 35.

An important feature of the extension 35 is that it is formed spanning a region below the raw material drop point A of the dead-bed 4.

For ease of explanation, the extension 35 is treated separately from the crushing member 31, but in fact it is integral therewith.

On one face of the crushing member 31 and the extension 35, a metal plate of ultra-hard metal is bonded by welding, an equivalent attachment or other processes known in the art process so as to create a hammer face 36.

In the example given here, the crushing vanes 3 are shown bolted close to the ejection ports 15. However, the attachment position of the crushing vanes 3 is not limited to this, and provided they are on the outer face of the rotor 1, they can be located away from the ejection ports 15.

Furthermore, although the attachment member 32 and the crushing member 31 of the crushing vane 3 are shown at right-angles to each other, other configurations such as an acute angle or an obtuse angle can be adopted, having regard to the balance between crushing effectiveness, wear and tear, and other factors, or, as an alternative to the L-shaped profile, the crushing vane may be formed as a rectangular body (or some other shape), of which one face forms the hammer face 36.

In addition, having regard to the desired crushing performance, the extent to which the crushing member 31 protrudes from the outer face of the rotor 1, and the distance of extension below the lowest point A of the dead-bed 4 may also be varied.

4. Annular Wall

The annular wall 5 is fitted along the inner rim of the opening of the lower plate 22.

The annular wall 5 extends downwards below the lower plate 22 by substantially the same length as the extensions 35 of the crushing vane 3 positioned opposite thereto.

Thus, the annular wall 5 is also located below the raw material drop point A of the dead-bed 4.

Preferable the annular wall 5 is fitted continuously around the entire inner rim of the lower plate 22, however it may be fitted intermittently.

Moreover, the annular wall 5 forms a space of fixed width between itself and the extensions 35 of the crushing vane 3 positioned opposite thereto.

Into this space fall finely fragmented particles of the raw material, forming a layer, and creating a so-called stone curtain 71.

Operation of the Invention

Figure 3:
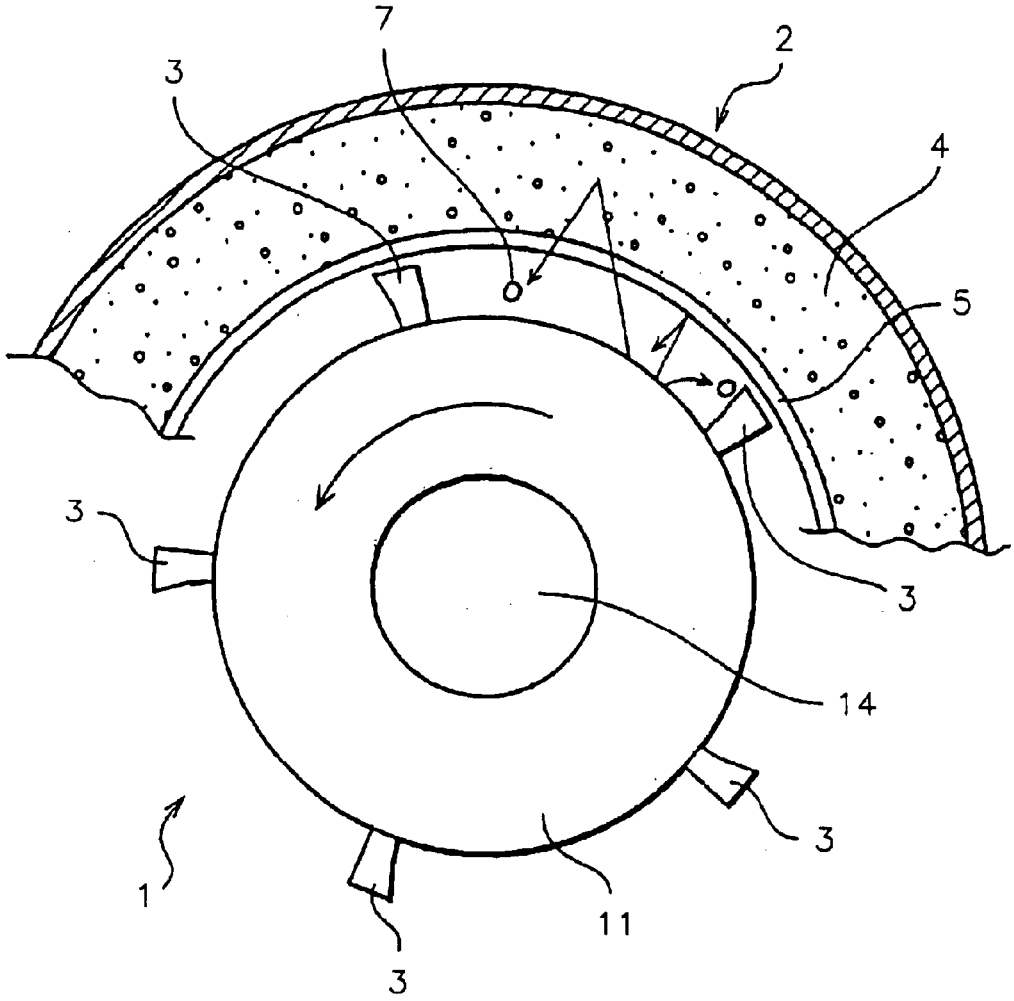
FIG. 3 is a horizontal cross-sectional view of a crusher through line 3—3 in FIG. 1 for explaining an operation of the invention.
Figure 4:
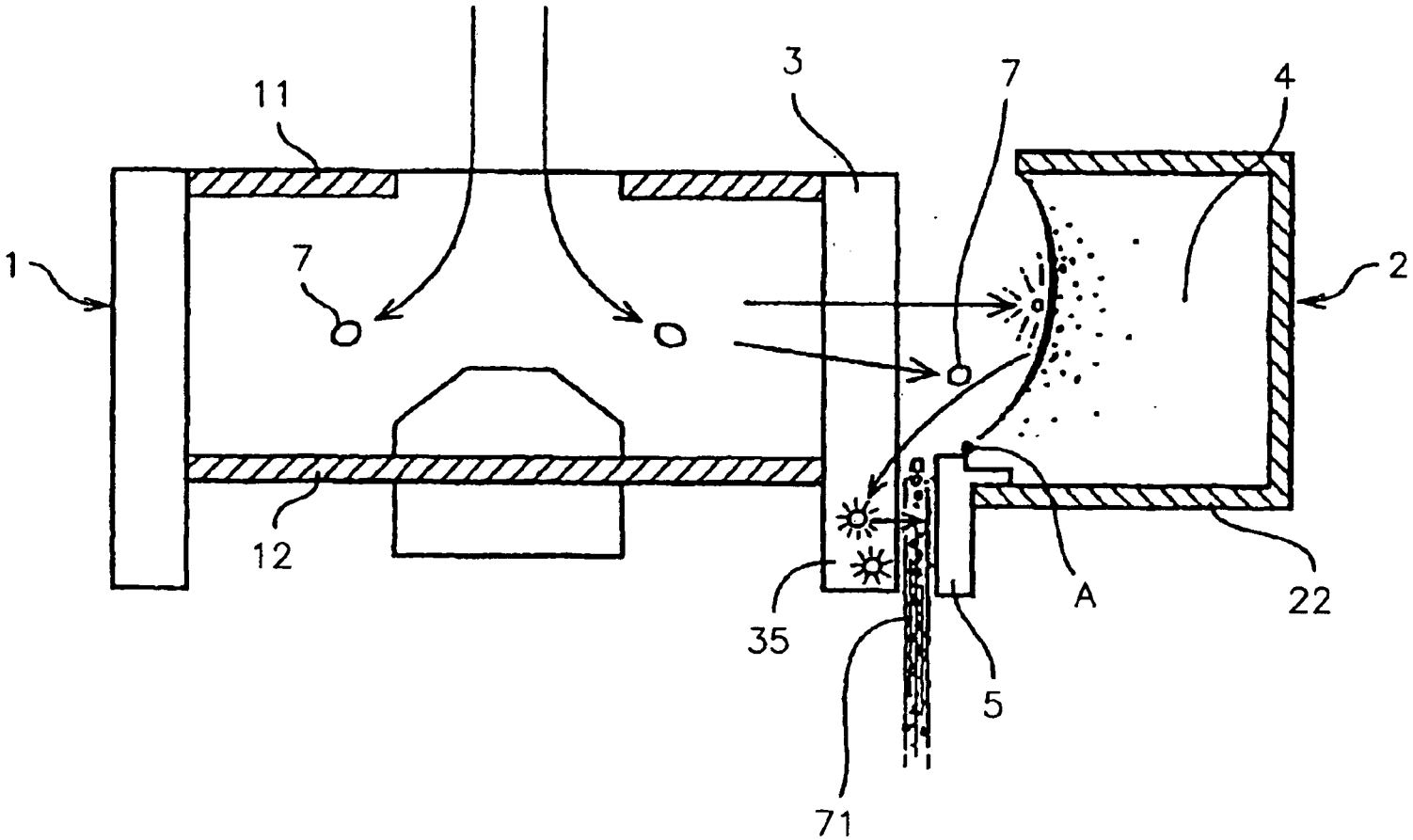
FIG. 4 is a vertical cross-sectional view of a crusher through line 4—4 in FIG. 1 for explaining an operation of the invention.

Next is a description of the operation of the present invention, with reference to FIG. 3 and FIG. 4.

1. Theory of Pulverisation

The mineral or other material to be pulverised 7 which is introduced into the interior of the rotor 1 via the feeder port 14, is ejected from the ejection ports 15 by the centrifugal force generated by the rotation of the rotor 1.

The ejected material 7 collides with the dead-bed 4 and is pulverised.

Finely pulverised material 7 falls between the rotor 1 and the crushing chamber 2, that is to say, as shown in FIG. 4, it falls through the gap between the annular wall 5 and the opposite extensions 35 of the crushing vanes 3, while forming the stone curtain 71.

The material to be pulverised 7 situated above the raw material drop point A, is broken up into fine particles by the pulverising effect of collision with the dead-bed 4 as mentioned before, and by the pulverising effect of striking the protruding crushing vanes 3 on the rotor 1.

In addition, the material 7 that falls below the raw material drop point A as shown in FIG. 4, is struck and pulverized by the extensions 35 of the crushing vanes 3, and some of the ricocheting material 7, collides with the stone curtain 71 and is broken up even more finely.

The material 7 that passes through the stone curtain 71 without colliding therewith is broken up finely by collision with the annular wall 5.

In this way the material 7 that falls below the raw material drop point A is broken up efficiently into fine particles by the extensions 35 of the crushing vanes 3, the stone curtain 71 and the annular wall 5.

Furthermore, the formation of the stone curtain 71 during the crushing process reduces the amount of material 7 that collides with the annular wall 5, with the effect that wear and tear on the annular wall 5 can be reduced.

2. Crushing Rate

Figure 5:
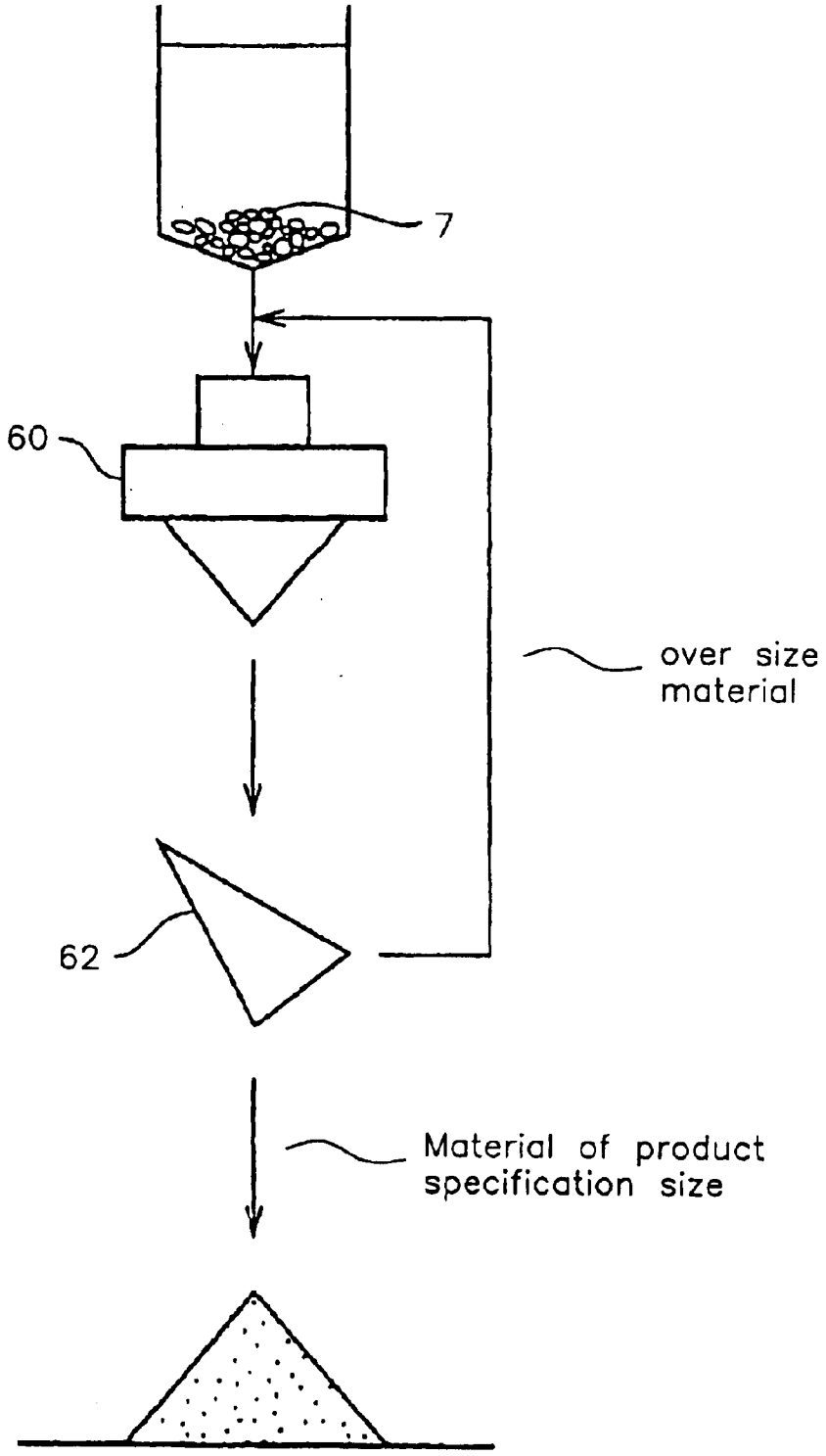
FIG. 5 is a flow diagram of the crushing process utilising the present invention.

As shown in FIG. 5, after being broken up by the crusher 60, the material 7 is graded by means of a screen 62, and the material 7 of a size that exceeds a predetermined end product size is collected from the screen 62 and fed back into a crusher 60.

The present invention can achieve a finer degree of pulverisation without adopting the method of increasing the speed of the rotor 1. This is done as described above, by colliding the material 7 which falls below the crushing vanes 3 formed with the extensions 35, against the stone curtain 71, and even if this passes through the curtain, this is collided with the annular wall 5 formed extending downwards.

The result is a significant reduction in the amount of material 7 that has to be collected from the screen 62, and a great reduction in the amount and number of times this has to be fed back into the crusher, resulting in a significant improvement in crushing productivity.

Moreover, because the present invention crushes more finely without increasing the speed at which the material 7 is ejected from the rotor 1, there is little concern regarding adverse influence on the durability of the crusher 60.

Second Embodiment of the Invention

Another embodiment according to the present invention is described below.

Figure 6:
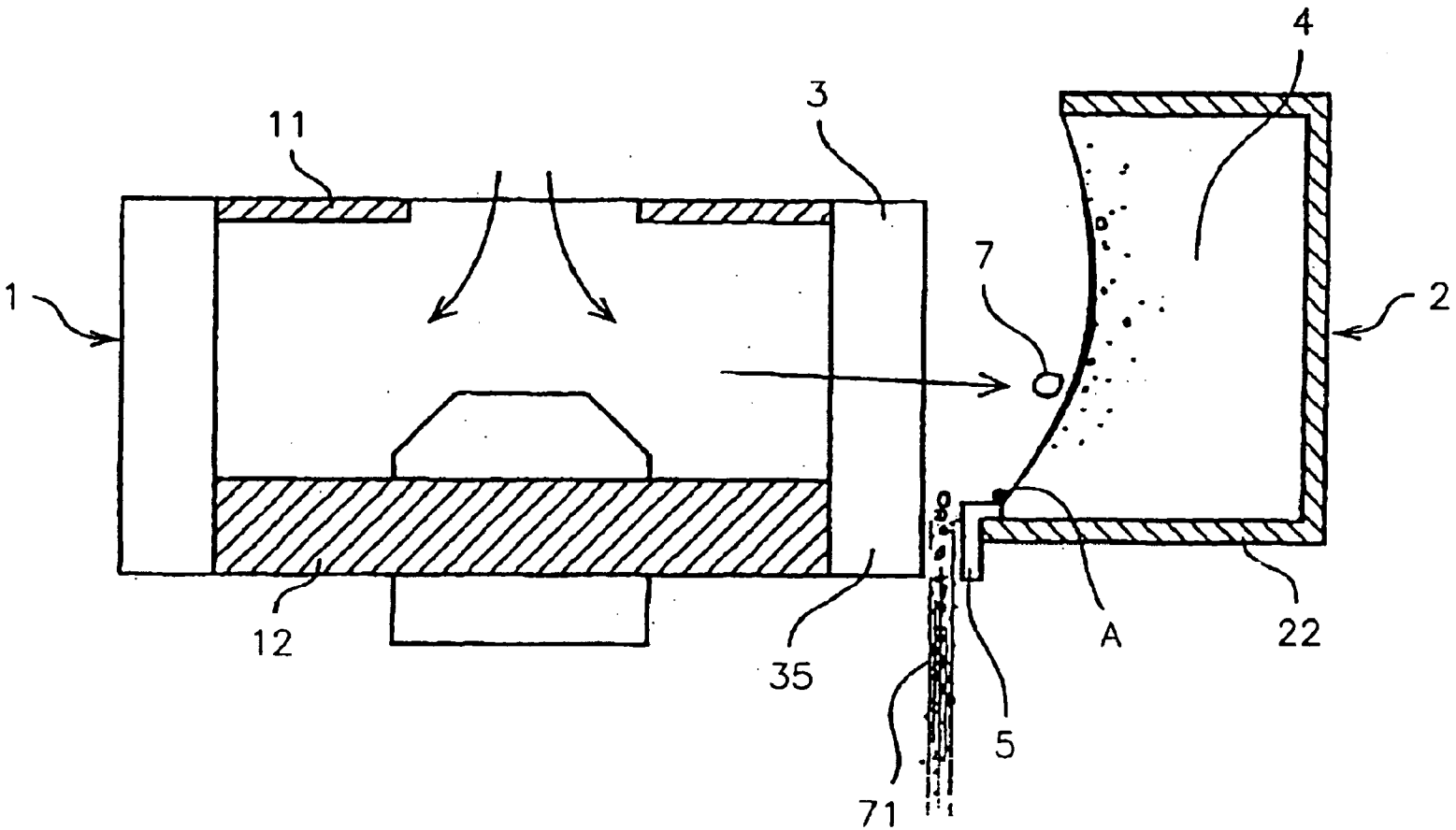
FIG. 6 is a vertical section view of a crusher along line 4—4 of FIG. 1 according to a second embodiment of the present invention.

The first embodiment showed a case in which the extensions 35 that extend below the level of the rotor 1 are formed on the crushing members 31 of the crushing vanes 3. However, this is not the only possible configuration, and for example, as shown in FIG. 6, the entire rotor 1 may be lowered relative to the annular wall 5.

Figure 7:
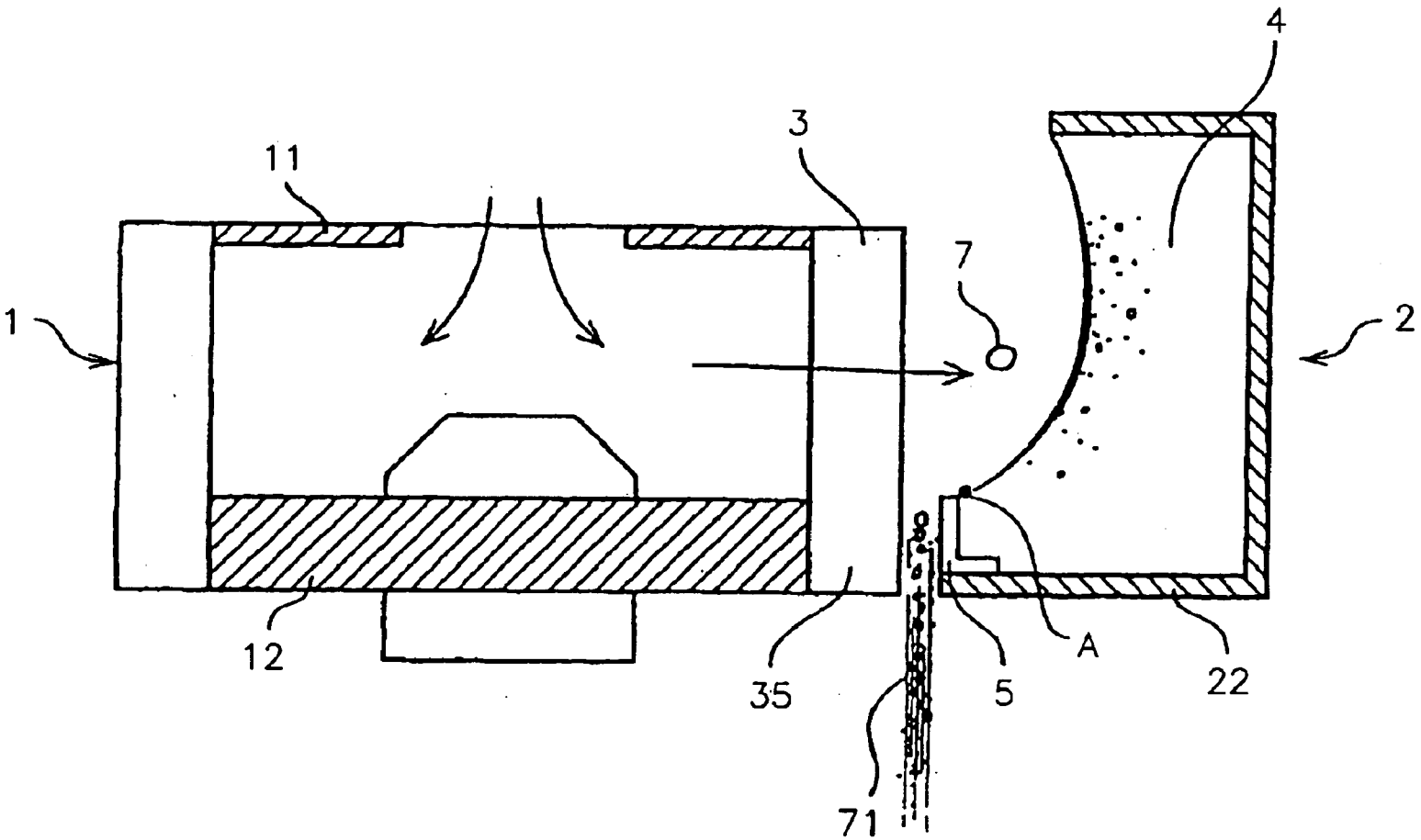
FIG. 7 is a vertical section view of a crusher according to a third embodiment of the present invention.

Moreover, as shown in FIG. 7, the annular wall 5 may be formed such that the annular wall 5 side is raised relative to the rotor 1.

Of importance to the present invention is that the extensions 35 and the annular wall 5 are located below the raw material drop point A, so that the material 7 can be struck and crushed at a position below the raw material drop point A.

Third Embodiment of the Invention

The annular wall 5 may also be omitted.

Industrial Applicability

The present invention, due to the above described form, achieves the following effects.

1. Because the crushing is performed by the crushing vanes formed with extensions extending below the raw material drop point, striking the material, finer and more uniform pulverisation is achieved without any increase in rotor speed.
2. When the annular wall is provided below the raw material drop point on the pulverising chamber side, crushing productivity is further increased, enabling a still greater improvement in crushing performance.
3. Since the material which has been struck by the extensions of the crushing vanes is broken up by colliding with the stone curtain, the volume of material striking the annular wall is reduced, thereby enhancing the durability of the annular wall.
4. Achieving a finer degree of pulverisation without increasing the size of motor avoids increased costs and eliminates the problem of increased weight.

5. Because a finer degree of pulverisation is achieved without an increase in the ejection velocity of the material, crusher durability is unimpaired.

6. Because a uniform degree of fineness is achieved, the amount of re-crushing involving the conventional re-introduction to a crusher via a conveying loop such as a belt conveyor, and the number of times this must be performed is greatly reduced, thus enhancing productivity.

What is claimed is:

1. A crusher comprising a cylindrical rotor which rotates about a vertical axis, and a pulverising chamber which houses said rotor, which performs a pulverising process by ejecting raw material to be crushed from ejection ports of the rotor so that it collides with a surrounding dead-bed, wherein crushing vanes are provided on an outer face of said rotor protruding radially therefrom, and said crushing vanes are formed with an extension located slightly below a raw material drop point of said dead-bed.

2. A crusher according to claim 1, wherein there is provided an annular wall inside said pulverising chamber, and located below the raw material drop point of said dead-bed.

* * * * *